United States Patent [19]

Blöchl et al.

[11] 4,203,386

[45] May 20, 1980

[54] ELECTROSTATIC COPIER WITH INSERTABLE DEVELOPER MODULE

[75] Inventors: Hanns Blöchl, Unterhaching; Georg Fryda, Munich; Erich Schlick, Riedmoos; Günther Schnall, Eching, all of Fed. Rep. of Germany

[73] Assignee: Agfa-Gevaert AG, Leverkusen, Fed. Rep. of Germany

[21] Appl. No.: 913,023

[22] Filed: Jun. 5, 1978

[30] Foreign Application Priority Data

Jun. 29, 1977 [DE] Fed. Rep. of Germany ..... 2729349

[51] Int. Cl.[2] ..... G03G 15/08; G03G 15/09

[52] U.S. Cl. ..... 118/653; 118/262; 118/656; 118/657; 118/658; 222/DIG. 1; 355/3 DD; 101/247

[58] Field of Search ..... 118/262, 653, 656, 657, 118/658; 222/DIG. 1; 355/3 DD; 101/218, 247

[56] References Cited

U.S. PATENT DOCUMENTS

| | | | |
|---|---|---|---|
| 3,976,371 | 8/1976 | Moser et al. | 118/653 X |
| 4,119,059 | 10/1978 | Moser et al. | 355/3 DD X |

FOREIGN PATENT DOCUMENTS

| | | | |
|---|---|---|---|
| 1961836 | 6/1971 | Fed. Rep. of Germany | 118/653 |
| 2436301 | 2/1976 | Fed. Rep. of Germany | 118/653 |

*Primary Examiner*—Roland E. Martin, Jr.
*Attorney, Agent, or Firm*—Michael J. Striker

[57] ABSTRACT

An electrostatic copier has a rotatable copy drum and a developing unit which can be inserted and removed from the copier in toto. The developing unit is provided with bearing members which at least partly and loosely embrace the shaft of the copy drum.

15 Claims, 4 Drawing Figures

III
III
B
A
1
3
3a
3b
6
7
8
8a
9
10
11
12
13
14c
14d
15
16
18
19
20
24
25
32
34
35
36
37
38
39
39a
40
40b
41

Fig. 3
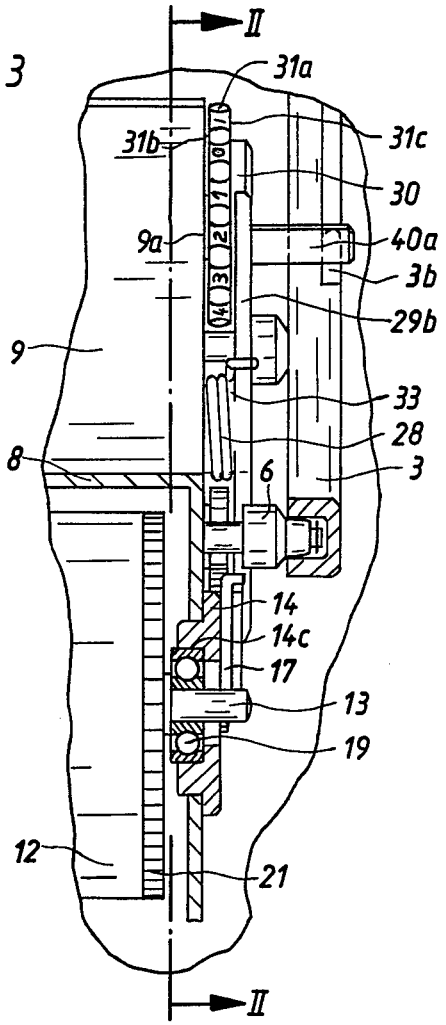
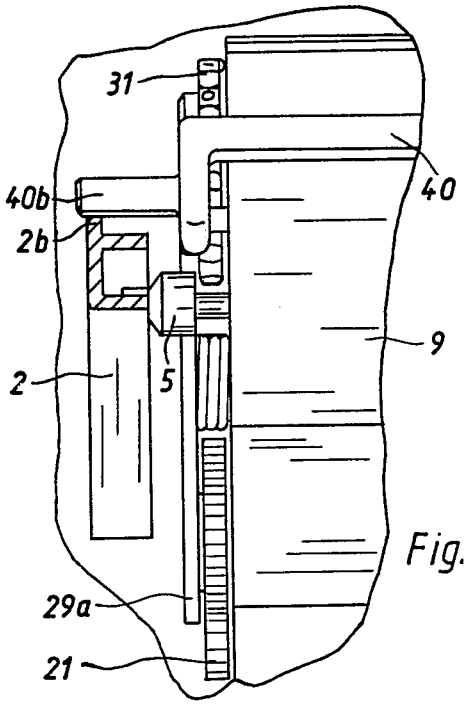
Fig. 4

ELECTROSTATIC COPIER WITH INSERTABLE DEVELOPER MODULE

BACKGROUND OF THE INVENTION

1. Field of the Invention

The present invention relates to electrostatic copiers. More particularly, the invention relates to an electrostatic copier having a developing station which can be inserted into and removed from the copier as a unit.

2. The Prior Art

In electrostatic copiers an original is imaged onto the photosensitive surface of an endless travelling charge carrier to create a latent electrostatic image thereon. Toner particles are then attracted to the charged area of the electrostatic image; i.e. the latent image is developed to form a visible image. The toner particles forming this visible image are thereupon transferred to an image carrier, e.g. a sheet of copy paper, and fused to provide a permanent image on the same. Various ways of developing the latent image have been proposed, including cascade developing in which the toner material is cascaded over the photosensitive surface of the travelling charge carrier, and magnetic brush developing. For ease of servicing it is desirable to be able to insert the entire developing station into the machine as a unit, and to remove it in the same manner and such as an arrangement has been proposed in e.g. German Published Application (DT-OS) 1,961,836.

The quality of the developing process—and hence the quality of the finished copy—depend to a very large extent upon a precise maintenance of the position of the developing unit or station relative to the charge carrier surface; this is important in almost all known developing processes, but especially so in cascade developing and magnetic brush developing. To assure such maintenance in constructions in which the developing station is removable as a unit, it has been proposed to use space rollers which engage the charge carrier surface to maintain the desired relative position of the station to this surface. However, the charge carrier surface is highly susceptible to damage and the use of such rollers inherently involves the danger of such damage, which may occur e.g. when the charge carrier is removed for inspection or replacement. To avoid this, the prior art proposes to retract the developing station—together with associated components—out of contact with the charge carrier surface before the charge carrier is removed. This, however, requires a rather complicated construction which is correspondingly expensive.

A somewhat different approach is adopted in German Published Application (DT-OS) 2,436,301 where the removal of the charge carrier is facilitated by combining it with a surface-cleaning device to form a removable unit therewith. This, however, does not change the fact that in this construction, also, the spacing between the developing station and the charge carrier surface is maintained by space rollers which must engage the charge carrier surface.

SUMMARY OF THE INVENTION

It is an object of the present invention to overcome the disadvantages of the prior art.

More particularly, it is an object of the invention to provide an improved electrostatic copies wherein the removal and installation of the charge carrier is facilitated and the danger of damage to the charge carrier surface is eliminated, or is at least substantially reduced.

Another object is to provide an improved electrostatic copier wherein the precise positioning and spacing of the charge carrier surface and developing station relative to one another, is simplified and facilitated.

A concomitant object is to provide such an improved electrostatic copier wherein the aforementioned objects are attained in a structurally simple and therefore relatively inexpensive manner.

In keeping with the above objects, and with still others which will become apparent hereafter, one aspect of the invention resides in an electrostatic copier wherein an original to be copied is imaged onto the photosensitive surface of an endless rotating charge carrier to form a latent electrostatic image thereon which is then developed by attraction of toner particles to the latent image, in a combination which comprises a housing; a shaft mounting the charge carrier for rotation; and a developing unit insertable in toto into the housing to a position proximal to the charge carrier, the developing station comprising bearing means which at least loosely embraces the shaft of the charge carrier.

In the copier according to the present invention the charge carrier, usually a copy cylinder or copy drum, forms with the developing station a unit which can be inserted into the machine and withdrawn from it, in toto. Any required servicing adjustments can be effected outside the copier, prior to insertion of the unit into the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a section taken on line III—III of FIG. 2; and

FIG. 4 is a section taken on line IV—IV of FIG. 1.

DESCRIPTION OF THE PREFERRED EMBODIMENTS

Figure 1:
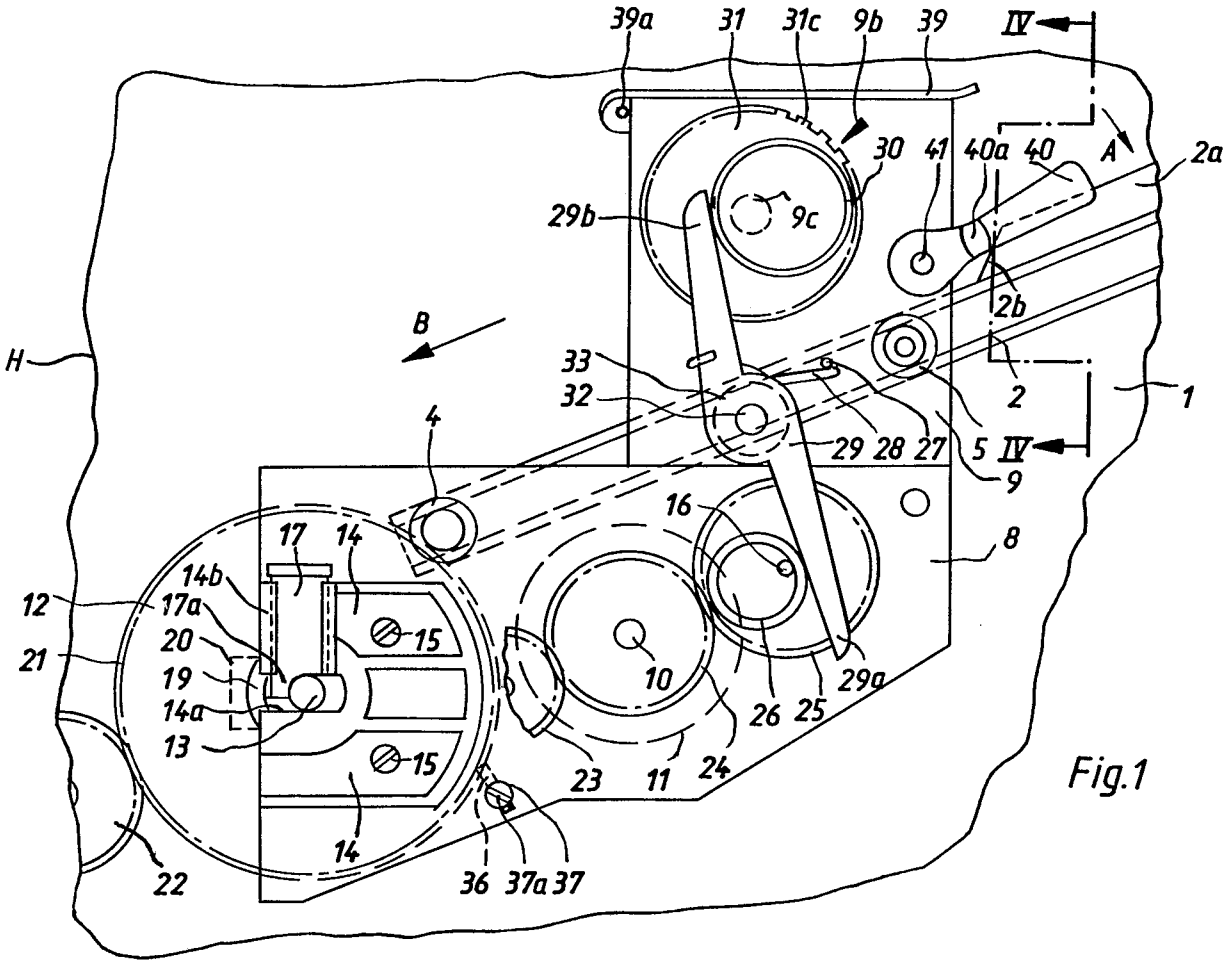
FIG. 1 is a fragmentary, partly broken away side view of a copier embodying the invention.
Figure 2:
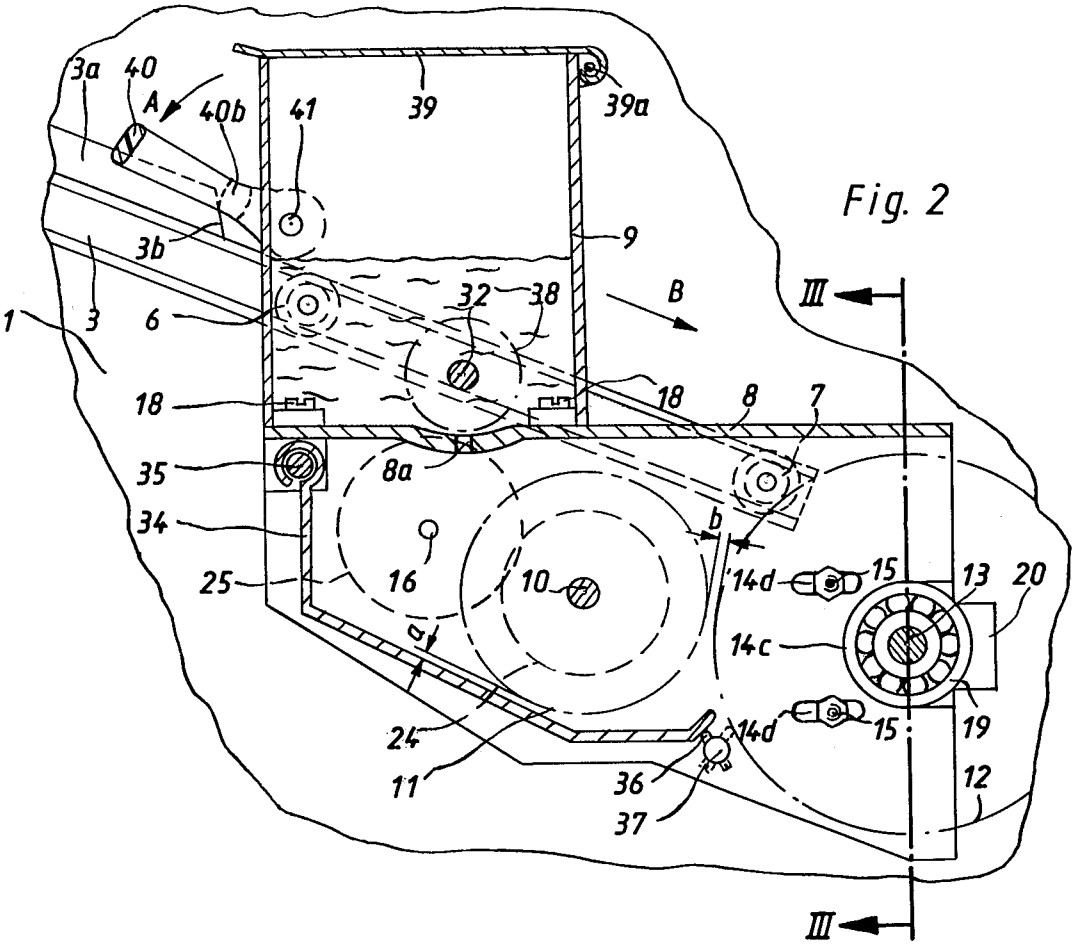
FIG. 2 is a section taken on line II—II of FIG. 3.

The drawing illustrates in FIGS. 1-4 a single, exemplary embodiment of the invention. Since only the illustrated aspects are of importance for an understanding of the invention, the remainder of the copies is not shown and the copier housing is shown only fragmentarily and designated with reference character H in FIG. 1.

As shown, the frame 1 of the copier is provided with guide rails 2 and 3 for a developer station which can be inserted and removed in toto; this station is guided for such movement by rollers 4–7 and has two housing sections 8 and 9 which are connected to one another by screws 18. The housing section 8 accommodates the actual developing equipment and the housing section 9 accommodates a toner metering device.

A shaft 10 is journalled in section 8 for rotation and carries a diagrammatically illustrated magnetic developer roller 11 (known per se) which dips with successive increments of its circumferential surface into a supply of magnetizable toner particles, so that these pafrticles are attracted to the roller 11 and form thereon a "brush" or "beard". During further rotation of the roller 11 these attracted particles are then transported to the surface of the charge carrier, which is here in form of a rotating drum 12 mounted on a shaft 13.

A pair of journalling members 14 (only one shown) is mounted on the housing section 8 by means of screws 15. Each of the members 14 has a forked slot 14*a* in which axially spaced portions of the shaft 13 are loosely retained. Members 14 are provided with prismatic guides 14*b* in which respective sliders 17 (one shown) are movable. These sliders 17 each have a hook-shaped formation 17*a* which is made to embrace the shaft 13 and prevent its disengagement from the slots 14*a* while the station having the sections 8, 9 is outside the copier. The members 14 are further each provided with a recess 14*c* which embraces, over an angle of about 180°, respective anti-friction bearings 19 which are pushed onto the shaft and journal the same for rotation. These bearings 19 are held and centered (both with respect to the copier and to the unit) by a bearing member 20 which is installed in the copier and engages the bearings 19 when the unit is in inserted (operating) position.

One end portion of the drum 12 is provided with a ring gear 21. The copier includes a drive gear 22 with which the ring gear 21 meshes when the developing station is in position within the machine, i.e. as shown in FIG. 1. Another gear 23 of the copier meshes with a gear 24 which is mounted on the shaft 10 of roller 11 and which in turn meshes with a gear 25 that is mounted on a shaft 16 and provided with an eccentric 26. A torsion spring 28 engages a projection 27 of the frame and reacts against a pivot lever 29 to urge an arm 29*a* of the same into tracking engagement with the eccentric 26. Another arm 29*b* of the lever 29 tracks an adjustable eccentric 30 which is mounted on a selector disk 31 of the type which is disclosed in detail in German Application P 26 36 920.0. The disk 31 has its circumference formed with depressions 31*a* (FIG. 3) for the fingers of a user; it also has detent portions 31*b* and selector indicia (e.g. a series of numerals) 31*c*. The housing section 9 is provided with a portion 9*a* which cooperates with the detent portions 31*b;* it also has an indexing mark 9*b* with which the selector indicia 31*c* cooperate. Thus, a desired setting of the adjustable eccentric 30 is selected by turning the disk 31 until an indicium 31*c* corresponding to the desired setting is located opposite the indexing mark 9*b;* the disk 31 is held in any selected position by cooperation of the portion 9*c* with the detent portions 31*b*. Depending upon the setting selected for the eccentric 30, the arm 29*a* can follow the movements of the rotating eccentric 26 to a greater or lesser extent, so that the lever will pivot to a greater or lesser degree.

To permit such pivoting of the lever 29, the same is journalled on a shaft 32 via a free-wheeling device (one-way coupling) 33. It can thus freely pivot on the shaft in one direction, but entrains and turns the shaft 32 when pivoting in the opposite direction. As a result, the shaft 32 is turned during each to-and-fro pivoting movement of lever 29, through an angular distance which corresponds to the setting selected with the disk 31. A toner brush 38 is mounted on the shaft 32 and turns with the same through corresponding angular distances; the brush 38 thus transports, during each rotation of the eccentric 26, a quantity of toner through bores 8*c* in housing section 8 to replenish the toner supply therein; the amount of toner so transported evidently depends on the degree of angular rotation of the brush 38. Refilling of the toner reservoir in housing section 9 can be effected manually, by opening a cover 39 which is hinged to a shaft 39*a* of the section 9.

The bottom of the toner supply compartment in housing section 8 is closed by a flap-type door 34 which can pivot about a shaft 35 between an open and a closed position. It is held in the latter position by grub screws 36 which are threaded into a turnable rod 37. To open the door 34 a user inserts the tip of a screwdriver or another suitable tool into a slot 37*a* at the outer end of the rod 37 and turns the rod until the screws 36 assume the broken-line position shown in FIG. 2, thus releasing the door 34 for movement. The purpose of providing screws 36, rather than non-adjustable elements, is to permit adjustment of the distance a between the door 34 and the roller 11, since precise setting of this distance is important for proper operation of the developing station.

Another distance which is important for the same reasons, is the distance b from the roller 11 to the charge carrying surface of the drum 12. To permit this latter distance to be adjusted, the mounting element 14 is shiftable along the elongated slots 14*d* through which the screws 15 extend, once the screws 15 are backed off. The distance b can then be precisely set before the unit is inserted into the copier; of course, since during such adjustment the bearings are not held by the bearing member 20 a corresponding element must be temporarily used to perform the holding function.

The section 9 has a shaft 41 on which a handle bracket 40 is provided which extends over the entire width of the unit. The bracket 40 has hooks 40*a* and 40*b* which engage behind cam portions 2*b*, 3*b* of members 2*a*, 3*a* that are mounted on the rails 2, 3. Thus, a movement of the bracket 40 in the direction of arrow A produces, via the cam portions 2*b*, 3*b*, a closing movement in direction of the arrow B which results in moving gear 21 into mesh with the gear 22, moving the gear 23 into mesh with the gear 24 and moving the bearing portions 14*a* and 20 to closed (journalling) position. The unit is now arrested and ready for operation.

The exemplary embodiment of FIG. 1 is susceptible of various modifications which are intended to be encompassed within the concept of the invention. For example, the journals for the shaft of the drum 12 need not merely be of two parts (i.e. portions 14*c* and 20) but could have more than those. The portions 14*c* and 20 also need not necessarily embrace the outer races of the bearings for shaft 13, in the manner shown in the drawing. Slider 17 could be replaced by another element which retains the shaft 13 in the slots 14*a* in a different manner. Bracket 40 need not extend over the entire width of the unit and could be replaced by a differently shaped and/or acting element.

Furthermore, the gear 23 could be used to rotate the drum 12 in addition to meshing with the gear 24, although the use of the separate gear 22 is currently preferred. It is also advantageous if the gear 22 is driven by the drive for an optical scanning device (known per se) which scans the original to be copied, since such an arrangement will assure minimum vibration in the gear train connecting the optical scanner (if the same is of the strip-scanning movable type) or the transporter for the original (in which case the scanner is of the stationary type) with the advancing charge carrier (e.g. the rotating drum 12). Such freedom from vibration (to at least the maximum possible degree) is of importance for the quality of the scan.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copier wherein an original to be copied is imaged onto the photosensitive surface of an endless rotating charge carrier to form a latent electrostatic image thereon which is then developed by attraction of toner particles to the latent image, a combination comprising a housing; a shaft mounting the charge carrier for rotation; and a developing unit insertable in toto into said housing in a position proximal to the charge carrier, said developing station comprising bearing means which embraces said shaft of the charge carrier.

2. A combination as defined in claim 1; and further comprising means on said developing unit for removably retaining said shaft in engagement with said bearing means.

3. A combination as defined in claim 1, said bearing means comprising first bearing members which embrace said shaft over at most 180° of arc; and further comprising second bearing members mounted in said housing, each cooperating with one of said first bearing members and each also embracing said shaft over at most 180° of arc.

4. A combination as defined in claim 1, said developing unit comprising a housing having two housing sections, one of said housing sections being formed with a pair of forked slots each having an open end and accommodating a length of said shaft; and means for retaining said shaft in the respective slot.

5. A combination as defined in claim 4, said retaining means comprising for each slot a slide member which is slidable across and retractable from the cross-section of the respective slot.

6. A combination as defined in claim 1, said bearing means comprising at least two first bearing members; further comprising at least two second bearing members each cooperating with one of said first bearing members and embracing said shaft when said unit is inserted in said housing; and means for arresting said unit when the same is inserted in said housing and for concomitantly closing the first and second bearing members about said shaft.

7. A combination as defined in claim 6, said unit having in direction normal to its path of movement into and out of said housing a predetermined width; and wherein said arresting means comprises a handle bracket extending over substantially said predetermined width.

8. A combination as defined in claim 1; further comprising a drive gear mounted in said housing; and a driven gear mounted on said unit and arranged to mesh with said drive gear in reponse to insertion of said unit into the housing.

9. A combination as defined in claim 1; further comprising a drive gear for the charge carrier mounted in said housing, and a driven gear on the charge carrier and arranged to mesh with said drive gear in response to insertion of said unit into the housing.

10. A combination as defined in claim 1; said unit comprising a toner reservoir, and means for forwarding successive quantities of toner from said reservoir to the charge carrier.

11. A combination as defined in claim 10, wherein said forwarding means comprises a toner transporting roller mounted for rotation, a driven shaft in said unit, an eccentric on said driven shaft, and a swing lever mounted on said toner transporting roller and coupled thereto via a one-way clutch, said swing lever having an arm tracking said eccentric so as to be swung in a sense imparting angular movement to said toner transporting roller in response to rotation of said eccentric.

12. A combination as defined in claim 11; further comprising means for limiting the degree of swinging of said lever.

13. A combination as defined in claim 11; further comprising adjustable means for limiting the swinging of said lever to a selectable degree.

14. A combination as defined in claim 13, wherein said adjustable means comprises an adjustable eccentric engaging another arm of said lever.

15. In an electrostatic copier wherein an original to be copied is imaged onto the photosensitive surface of an endless rotating charge carrier to form a latent electrostatic image thereon which is then developed by attraction of toner particles to the latent image, a combination comprising a housing; a shaft mounting the charge carrier for rotation; a developing unit insertable in toto into said housing in a position proximal to the charge carrier, said developing station comprising bearing means including at least two first bearing members embracing said shaft of the charge carrier; at least two second bearing members each cooperating with one of said first bearing members when said unit is inserted in said housing; and at least two anti-friction bearings each mounted on said shaft and having an outer race which is embraced and held by a respective pair of cooperating first and second bearing members.

* * * * *